US007789563B2

(12) United States Patent
Kiyoo

(10) Patent No.: US 7,789,563 B2
(45) Date of Patent: Sep. 7, 2010

(54) VALVE GEAR

(75) Inventor: Mihara Kiyoo, Mino (JP)

(73) Assignee: Ad Japan Corporation, Osaka (JP)

( * ) Notice: Subject to any disclaimer, the term of this patent is extended or adjusted under 35 U.S.C. 154(b) by 847 days.

(21) Appl. No.: 10/564,616

(22) PCT Filed: Jul. 14, 2004

(86) PCT No.: PCT/JP2004/010376

§ 371 (c)(1),
(2), (4) Date: Jul. 26, 2006

(87) PCT Pub. No.: WO2005/007524

PCT Pub. Date: Jan. 27, 2005

(65) Prior Publication Data

US 2007/0017846 A1 Jan. 25, 2007

(30) Foreign Application Priority Data

Jul. 16, 2003 (JP) ..... 2003-197984

(51) Int. Cl.
*B65D 33/01* (2006.01)
*F16L 37/28* (2006.01)

(52) U.S. Cl. ..... 383/103; 251/149.2

(58) Field of Classification Search ..... 206/524.8; 251/61.1, 77, 331, 149.1, 149.6, 149.7, 149.2; 383/100, 103, 44; 220/745; 141/8; 137/512.5, 137/854, 550

See application file for complete search history.

(56) References Cited

U.S. PATENT DOCUMENTS 2,576,322 A * 11/1951 Waters ..... 383/103
3,595,467 A * 7/1971 Goglio ..... 383/103
5,332,095 A * 7/1994 Wu ..... 206/524.8
5,450,963 A * 9/1995 Carson ..... 206/524.8
5,584,409 A * 12/1996 Chemberlen ..... 220/89.1
5,893,461 A * 4/1999 Walters ..... 206/524.8
6,070,728 A * 6/2000 Overby et al. ..... 206/524.8
6,408,872 B1 * 6/2002 Skeens et al. ..... 137/512.15
6,604,634 B2 * 8/2003 Su ..... 206/524.8
6,712,334 B2 * 3/2004 Motonaka et al. ..... 251/149.6
7,398,953 B2 * 7/2008 Anderson ..... 251/82
7,438,473 B2 * 10/2008 Borchardt ..... 383/103

(Continued)

FOREIGN PATENT DOCUMENTS

JP 4065774 U 6/1992

(Continued)

*Primary Examiner*—Jes F Pascua
(74) *Attorney, Agent, or Firm*—Ronald E. Greigg

(57) ABSTRACT

A bag evacuation valve mechanism which can be used with suction devices having suction nozzles of different diameters and does not damage tightly closed bag stacked thereon to form a flat and stable shape of packing. A suction connector attached to the outer surface of a bag having a hole formed therein, and having a vent formed in its center has a generally flat shape, and a valve base on the inner surface of the bag has a recessed shape in cross-section. Such a valve mechanism can be used with suction devices having different nozzle diameters by placing the nozzle in contact with the suction connector to covering its vent, and as it has no projection on the outer side of a tightly closed bag, it does not damage any other, for example, tightly closed bag stacked on its outside or placed adjacent to it.

10 Claims, 3 Drawing Sheets

U.S. PATENT DOCUMENTS

| | | | | |
|---|---|---|---|---|
| 7,475,864 | B2 * | 1/2009 | Tanaka | 251/82 |
| 2005/0036718 | A1 * | 2/2005 | Wu et al. | 383/103 |
| 2009/0232423 | A1 * | 9/2009 | Sabounjian | 383/100 |

FOREIGN PATENT DOCUMENTS

| | | |
|---|---|---|
| JP | 5-124656 | 5/1993 |
| JP | 05035776 U | 5/1993 |
| JP | 7035340 U | 6/1995 |
| JP | 2001-233384 | 8/2001 |

* cited by examiner

VALVE GEAR

CROSS-REFERENCE TO RELATED APPLICATIONS

This application is a 35 USC 371 application of PCT/JP2004/010376 filed on Jul. 14, 2004.

BACKGROUND OF THE INVENTION

1. Field of the Invention

This invention relates to an improved bag evacuation valve, and more particularly to such a valve which can be used with evacuation devices having suction nozzles of widely differing diameter, and which does not damage any other, for example, tightly closed bag stacked on its outside or placed adjacent to it, while allowing bags stacked on or adjacent to one another to form a flat and stable shape of packing.

2. Description of the Related Art

As a bag for holding its contents by keeping them from the ambient air, there is known, for example, a tightly closed and compressed bag from which air is forced out by suction to reduce its volume as evacuated and the volume of its contents (if compressible). A compressed and tightly closed bag will hereinafter be referred to simply as a "tightly closed bag" unless any particular necessity to the contrary arises.

A tightly closed bag as mentioned above is sometimes equipped with a valve mechanism for keeping its inside and outside from each other so that when air has been forced out from its inside by suction, a negative pressure prevailing in its inside may not allow air to flow in from its outside as known, for example from Japanese Patent JP-A-6-227551 and JP-UM-A-4-132043.

According to the above documents, however, a tightly closed bag has a connector projecting from its valve mechanism mounting side for connecting the nozzle of a suction device, and it produces inconveniences as pointed out below. More specifically, the known valve mechanism has a problem in that the diameter (or shape) of the suction device nozzle does not suit the shape of the connector projecting from the valve mechanism mounting side.

Moreover, it is likely to result from the projection of the connector from the valve mechanism mounting side of a tightly closed bag that when tightly closed bags holding their contents are stacked on one another, the load of an upper bag may be concentrated on the projecting portion of a lower bag and the resulting stress may damage the contents of the upper bag. Furthermore, it has been likely that stacked bags may not form a flat shape of packing, but may make an inclined shape formed by the gradual elevation of their valve mechanism mounting portions, making it impossible to stack many tightly closed bags holding their contents on one another.

Moreover, it has been likely that the connector projecting from the valve mechanism mounting side of one tightly closed bag may interfere with another tightly closed bag, for example, stacked as mentioned above and damage it.

SUMMARY OF THE INVENTION

It is an object of this invention to solve the problems as pointed out above and provide a valve mechanism which can be used regardless of the diameter of the nozzle of a suction device, and does not damage any other, for example, tightly closed bag stacked on its outside or placed adjacent to it, while allowing bags stacked on or adjacent to one another to form a substantially flat and stable shape for packing.

In order to attain the above object, the valve mechanism according to this invention has a suction connector mounted on the outer side of a tightly closed bag having a hole formed therein, the suction connector having a vent formed in its center and being so shaped as not to form any projection on the outer side of the tightly closed bag, and a valve base mounted on the inner side of the tightly closed bag and having a recessed shape in cross section. Thus, it can be used regardless of the diameter of the nozzle of a suction device, does not damage any other, for example, tightly closed bag stacked on its outside or placed adjacent to it, but allows bags stacked on, or placed adjacent to one another to form a flat and stable shape of packing.

BRIEF DESCRIPTION OF THE DRAWINGS

The foregoing and other features and advantages of the valve mechanism of this invention will become apparent from the detailed description contained herein below, taken in conjunction with the drawings, in which.

DETAILED DESCRIPTION OF THE INVENTION

Figure 1A:
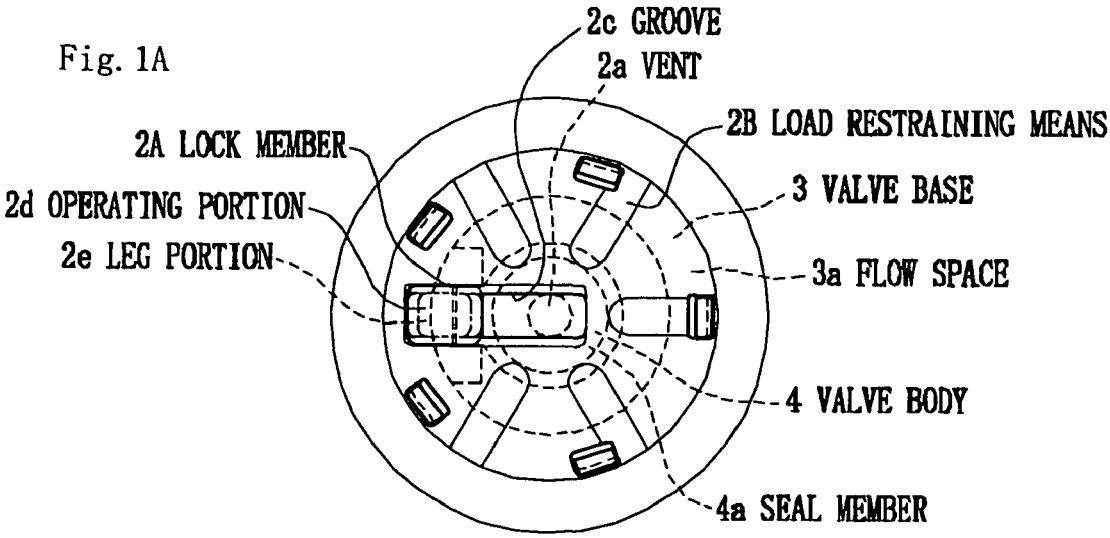
FIG. 1A is a top plan view of a valve mechanism according to this invention.

The valve mechanism according to this invention is a valve mechanism attached to a tightly closed bag for holding its contents by keeping them from the ambient air and adapted to open for discharging air from the tightly closed bag and close for stopping such discharging, and comprising: a suction connector mounted on the outer side of a tightly closed bag having a hole formed therein, the suction connector having a vent formed in its center and being so shaped as not to form any projection on the outer side of the tightly closed bag; a valve base mounted on the inner side of the tightly closed bag and having a recessed shape in cross section, a suction opening formed in its center as viewed in top plan and an edge portion joined to the suction connector with the tightly closed bag held therebetween; and a valve body facing the suction opening within the valve base and adapted to open the suction opening upon suction through the vent and close it upon stoppage of the suction.

The suction connector mounted on the outer side of a tightly closed bag having a hole formed therein is so shaped as not to have any portion projecting from the outer side of the tightly closed bag and has a vent formed in its center. The term "so shaped as not to have any projecting portion" means, for example, a flat shape, or a shape which is arcuate in cross section to the extent not exceeding the thickness of its edge portion.

The shape of the suction connector may also be a shape which is arcuate in cross section to the extent, for example, not exceeding the height of the recessed shape in cross section of the valve base when fitted therein as will be described later.

As it has hitherto been usual for a tightly closed bag to have a portion projecting from its outer side for connection with the nozzle of a suction device, it has been, for example, the case that the nozzle diameter does not suit it, or that its projecting portion damages any other, for example, tightly closed bag, but according to this invention, the suction connector so shaped as not to have any projecting portion can be used with any nozzle regardless of its diameter.

As there is no projection on the outer side of the tightly closed bag, the tightly closed bag in which the valve mechanism according to this invention is adopted can be stacked on, or placed adjacent to any other, for example, tightly closed bag without interfering with it, and therefore, without damaging it, while bags stacked, or placed adjacent to one another make a flat and stable form of packing.

The valve body attached on the inner side of a tightly closed bag has a recessed cross section, and preferably an arcuate cross section, so that when air is discharged from the tightly closed bag holding its contents, the valve body may not damage its contents or leave any flaw thereon, even if it may be brought into close contact with them. Thus, the valve mechanism according to this invention can restrain its suction connector from projecting on the outer side of a tightly closed bag, as the valve body is situated in the valve base having a recessed cross section.

The valve mechanism according to this invention also has a ring member made of an elastic material and attached integrally to the valve base, for example, its edge portion, or for example, its outer peripheral surface having a recessed cross section, and the suction connector has a concavity formed in its portion corresponding in position to the ring member attached to the valve base. This ensures that when the valve mechanism is mounted in the hole formed in a tightly closed bag, the bag should be held between the ring member of an elastic material, such as rubber or a resin, and the concavity and thereby prevent any air from flowing in through between the suction connector and the valve base put together. The bag held between the ring member and the concavity is protected from breaking, as the ring member is of an elastic material.

The valve mechanism according to this invention also has a plurality of ridges formed on the opposite side of the valve base from the suction connector and extending from the periphery of a suction opening. This ensures that even when air is discharged from the tightly closed bag, the suction opening should not be closed by the contents of the bag, but enable air to be discharged satisfactorily.

The valve mechanism according to this invention also has load restraining means provided around the vent of the suction connector for restraining the load of the suction device used for discharging air from the tightly closed bag. The load restraining means may, for example, be formed by stepped portions keeping the nozzle of the suction device and the suction connector from making close contact with each other, or by holes extending through the suction connector. This ensures that even after evacuating air from the tightly closed bag, the suction device should properly draw air from outside the tightly closed bag and thereby have its load restrained.

Figure 1B:
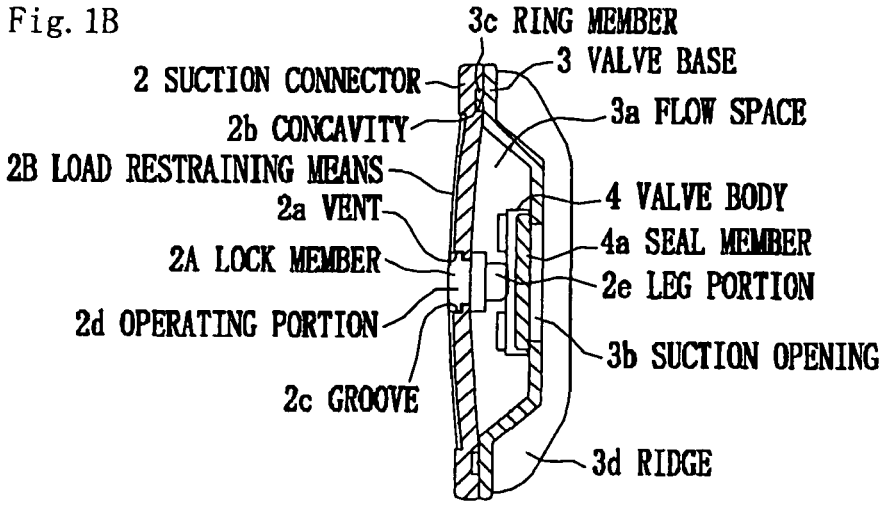
FIG. 1B is a cross sectional view of FIG. 1A.
Figure 1C:
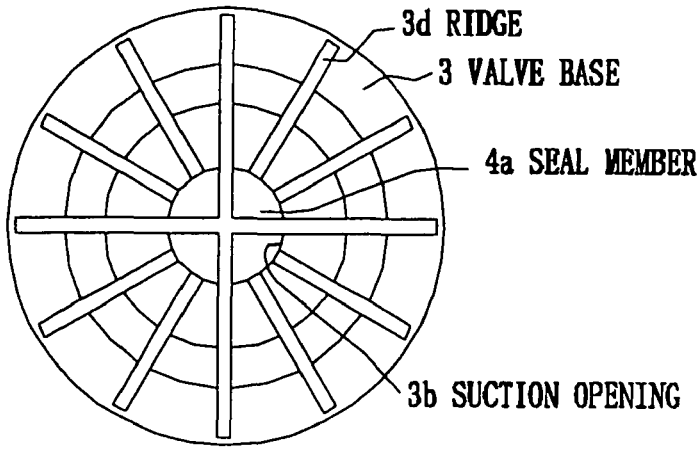
FIG. 1C is a bottom plan view thereof.
Figure 3:
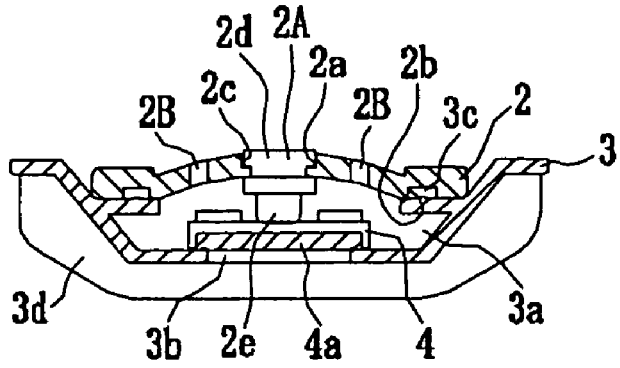
FIG. 3 is a cross sectional view showing another form of the suction connector in the valve mechanism according to this invention.
Figure 4:
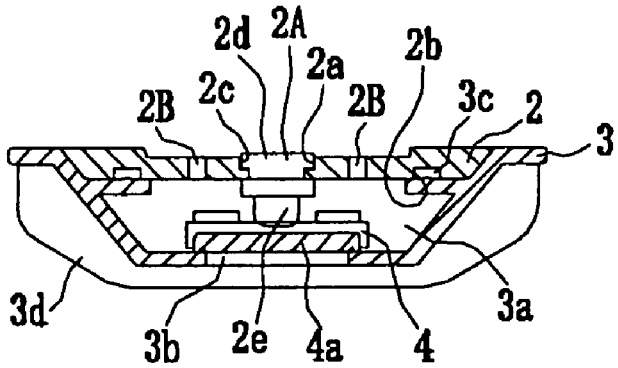
FIG. 4 is a cross sectional view showing still another form of the suction connector in the valve mechanism according to this invention.
Figure 5:
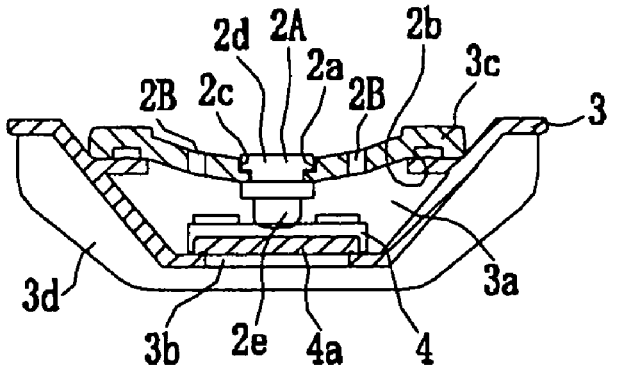
FIG. 5 is a cross sectional view showing still another form of the suction connector in the valve mechanism according to this invention.

Description will now be made of embodiments of this invention with reference to the drawings. FIGS. 1 and 2 show a valve mechanism embodying this invention. FIGS. 3 to 5 show other forms of valve mechanisms embodying this invention. The valve mechanism 1 according to this invention is mounted in a hole made in a tightly closed bag, not shown, for holding its contents by keeping them from the ambient air, and the embodiment shown in FIGS. 1 and 2 is constructed as described below.

The valve mechanism 1 has a circular suction connector 2 attached to the outer side of the hole of the tightly closed bag, as will be described below. The suction connector 2 is substantially circular in order not to damage the tightly closed bag. The suction connector 2 has an arcuate cross section protruding outwardly from the outer side of the tightly closed bag to the extent not exceeding the thickness of the edge portion of the suction connector 2 according to the embodiment under description, and has a hole formed in its center as viewed in top plan, and defining a vent 2*a*. The suction connector 2 has a concavity 2*b* formed in its position facing the edge portion of a valve base 3 as will hereinafter be described.

Moreover, the suction connector 2 has a groove 2*c* formed diametrically outwardly from the vent 2*a*. A lock member 2A is installed in the groove 2*c* slidably along it. The lock member 2A has an operating portion 2*d* exposed on the outside of the tightly closed bag from the groove 2*c* and a leg portion 2*e* formed integrally with it and protruding toward the inside of the tightly closed bag.

The suction connector 2 according to the embodiment under description has stepped portions formed in its surface on the outer side of the tightly closed bag and defining load restraining means 2B. The load restraining means 2B keep the nozzle of a suction device from making intimate contact with the upper surface of the suction connector 2, so that the nozzle may properly draw air from outside of the tightly closed bag, while drawing air from its inside, whereby it is possible to restrain any large load from acting suddenly upon the suction device after air has been discharged from the tightly closed bag.

The valve mechanism 1 has a circular valve base 3 mounted on the inner side of the hole of the tightly closed bag as will hereinafter be described. The valve base 3 has a recessed cross section, or a generally trapezoidal cross section according to the embodiment under description, which defines a flow space 3*a* in its inside and has a suction opening 3*b* formed in its center as viewed in top plan. Moreover, the valve base 3 has a ring member 3*c* of an elastic material, such as a resin, attached to its edge portion integrally therewith. The ring member 3*c* fits in the concavity 2*b* of the suction connector 2 by elastic deformation, while holding the edge portion of the hole of the tightly closed bag therebetween.

Moreover, the valve base 3 has 12 radial ridges 3*d* formed on its surface opposite the surface in which it is joined to the suction connector 2, or on its surface facing the inside of the tightly closed bag, and extending from the suction opening 3*b*. The ridges 3*d* are formed to ensure the passage of air to the suction opening 3*b*, and do not necessarily have to extend from the edge of the suction opening, nor is their number limited if it is plural.

The ridges 3*d* are curved at their ends and edges so as not to damage the contents when contacting them. The suction connector 2 and the valve base 3 are joined together by the ring member 3*c* fitted in the concavity 2*b* with the edge portion of the bag adjacent the periphery of the hole on the inner side of the tightly closed bag held therebetween, as stated above, whereby the valve mechanism 1 is attached to the tightly closed bag.

The valve mechanism 1 also has a valve body 4 adapted to open and close the suction opening 3*b* of the valve base 3. The valve body 4 is, for example, hinged at one end to open and close at another end opposite diametrically of the suction opening 3*b*. The valve member 4 has a seal member 4*a* of a resin on its rear surface.

The valve mechanism 1 having the construction described above first has its suction connector 2 positioned outside a tightly closed bag and its valve base 3 positioned inside it, so that the concavity 2*b* of the suction connector 2 and the ring member 3*c* of the valve base 3 may face each other along the edge portion of the hole in the tightly closed bag, and the ring member 3*c* is fitted in the concavity 2*b* with the edge portion of the hole of the bag held therebetween. The edge portion of the bag adjacent the hole of the tightly closed bag held between the concavity 2*b* and the ring member 3*c* is not damaged as the ring member 3*c* is of an elastic material, and the suction connector 2 and the valve base 3 are joined firmly and held against movement.

Figure 2A:
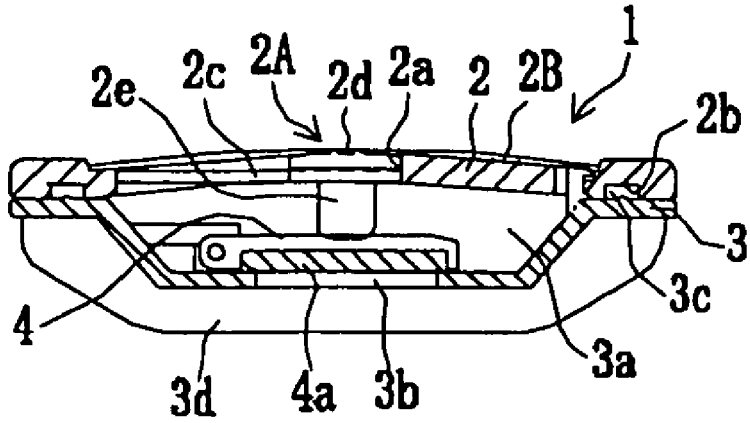
FIG. 2A is a view showing the locked position of the valve mechanism according to this invention.
Figure 2B:
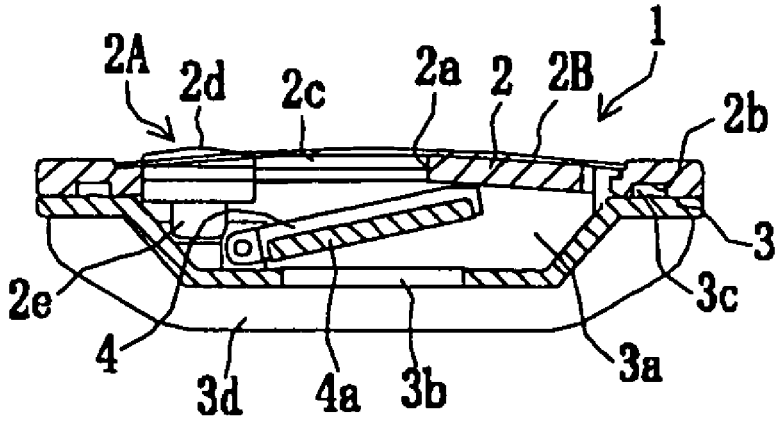
FIG. 2B is a view showing its unlocked position.

After its contents are put in the tightly closed bag and its opening is closed, the lock member 2A is caused to slide along the groove 2*c* as shown from FIG. 2A to FIG. 2B. As a result, the valve body 4 has its upper surface released from the pressure of the leg portion 2*e* so as to open at the other end.

Then, a suction device has its nozzle placed on the upper surface of the suction connector 2 so as to cover its vent 2*a* and its suction is started. As its suction is started and proceeds, the valve body 4 is rotated at one end to swing at the other end and open the suction opening 3*b*.

Air is evacuated from the tightly closed bag through the suction opening 3*b*, flow space 3*a* and vent 2*a*. Although a gradual reduction in volume of the tightly closed bag may cause its contents to approach the suction opening 3*b* closely, the ridges 3*d* keep the suction opening 3*b* from being blocked by its contents.

Although the discontinuation of the suction may result in the close contact of the valve base 3 with the contents of the bag, and although the load of an upper bag in a stack may cause the close contact of the valve base 3 in a lower bag with its contents, the ridges 3*d* rounded edges according to the embodiment under description do not damage the contents of the bag.

If the operating portion 2*d* of the lock member 2A is moved back along the groove 2*c* to the center of the suction connector 2 by the nozzle of the suction device upon discontinuation of its suction, the valve body 4 is locked by the leg portion 2*e*. The lock member 2A and the groove 2*c* are, however, not always the essential features, since the valve body 4 is drawn inwardly by the negative pressure prevailing in the tightly closed bag.

When a plurality of tightly closed bags are stacked or placed adjacent to one another after they are supplied with their contents and compressed, the valve mechanism 1 according to this invention having its suction connector 2 formed in a flat shape does not make any projection on the outer side of any tightly closed bag, but allows the bags to form a flat and stable shape of packing.

Description will now be made of the valve mechanism 1 shown in FIG. 3. According to the embodiment shown in FIG. 3, a suction connector 2 has an arcuate cross section protruding greatly beyond the thickness of its edge portion from the outer side of a tightly closed bag. The suction connector 2 is confined in the recessed cross section of a valve base 3 so that its arcuate cross sectional portion may not protrude beyond the height of the recessed cross section of the valve base. Thus, the structure shown in FIG. 3 is also so formed that the suction connector 2 may have the shape not forming any projection on the outer side of a tightly closed bag.

According to the embodiment shown in FIG. 3, load restraining means 2B are formed by holes extending through the suction connector 2. The load restraining means 2B are formed along the outer circumference of the suction connector 2 as far as possible, so as not to be traversed by the diameter of the nozzle of the suction device.

The valve base 3 has a horizontal step formed at a specific level of height on the side wall of its recessed cross section, and carrying a ring member 3*c*. The ring member 3*c* is fitted in the concavity 2*b* of the suction connector 2 to join the suction connector 2 and the valve base 3 together.

The embodiment shown in FIG. 4 is differentiated from the structure shown in FIG. 3 by a suction connector 2 having an edge portion equal in height to that of a valve base 3, and by the suction connector 2 having an outline so shaped as to fit the outline of the edge portion of the valve base 3 without allowing any clearance therebetween except for the wall thickness of a tightly closed bag. Thus, the structure shown in FIG. 4 is also so formed that the suction connector 2 may have the shape not forming any projection on the outer side of a tightly closed bag.

According to FIG. 4, the suction connector 2 has a central portion somewhat recessed below its edge portion to position the nozzle of a suction device. Moreover, the recessed central portion of the suction connector 2 has load restraining means 2B formed along its outer circumference.

The embodiment shown in FIG. 5 is differentiated from the structure shown in FIG. 3 by a suction connector 2 having an arcuate cross section protruding greatly beyond the thickness of its edge portion toward the inside of a tightly closed bag. Thus, the structure shown in FIG. 5 is also so formed that the suction connector 2 may have the shape not forming any projection on the outer side of a tightly closed bag.

While specific shapes have been shown by the embodiments shown in FIGS. 3 to 5 for "the shape" of the suction connector 2 "not forming any projection on the outer side of a tightly closed bag", they are not limiting if it is so shaped as not to interfere with any other, for example, tightly closed bag stacked on, or placed adjacent to one tightly closed bag, or damage it, while allowing bags stacked on, or placed adjacent to one another to form a flat and stable shape of packing.

As described above, the valve mechanism according to this invention has a suction connector mounted on the outer side of a tightly closed bag having a hole formed therein, the suction connector having a vent formed in its center and being so shaped as not to form any projection on the outer side of the tightly closed bag, and a valve base mounted on the inner side of the tightly closed bag and having a recessed shape in cross section, the valve mechanism according to this invention can be used with any nozzle regardless of its diameter, and a tightly closed bag in which the valve mechanism according to this invention is adopted can be stacked on, or placed adjacent to any other, for example, tightly closed bag without interfering with it, and therefore without damaging it, while bags stacked on or adjacent to one another can form a flat and stable shape of packing. It is to be understood that reference herein to "any nozzle regardless of its diameter" is intended to refer to the suction nozzle of suction devices such as vacuum cleaners or the like normally employed to evacuate such bags.

The valve mechanism according to this invention also has a ring member made of an elastic material and attached integrally to the valve base and the suction connector has a concavity formed in its portion corresponding in position to the ring member attached to the valve base, so that when the valve mechanism is mounted in the hole formed in a tightly closed bag, the bag maybe held between the ring member and the concavity and thereby prevent air from flowing in through between the suction connector and the valve base put together. The bag held between the ring member and the concavity is protected from breaking, as the ring member is of an elastic material.

The valve mechanism according to this invention also has ridges formed on the opposite side of the valve base from the suction connector and extending from the periphery of a suction opening, so that even when air is evacuated from the tightly closed bag, the suction opening may not be closed by the contents of the bag, but may enable air to be evacuated satisfactorily.

The valve mechanism according to this invention also has load restraining means provided around the vent of the suction connector for restraining the load of the suction device used for discharging air from the tightly closed bag, so that even after discharging air from the tightly closed bag, the suction device may properly draw air from outside the tightly closed bag and thereby have its load restrained.

The foregoing relates to a preferred exemplary embodiment of the invention, it being understood that other variants and embodiments thereof are possible within the spirit and scope of the invention, the latter being defined by the appended claims.

What is claimed is:

1. A valve mechanism to be attached to a tightly closed bag for holding its contents by keeping the contents from the ambient air and adapted to open for evacuating air from the tightly closed bag and close for stopping such evacuation, the valve mechanism comprising:

a suction connector to be mounted at a peripheral edge thereof on the outer surface of a tightly closed bag within a hole formed in the bag, the peripheral edge having a thickness, the suction connector having a vent formed in its center and having a shape which does not project relative to the peripheral edge on a side of the suction connector facing outside the tightly closed bag more than the thickness of the peripheral edge;

a valve base to be mounted on the inner surface of the tightly closed bag and having a recessed shape in cross-section, a suction opening formed in its center as viewed in top plan, and an edge portion adapted to be joined to the suction connector with the tightly closed bag held therebetween; and a valve body facing the suction opening within the valve base and adapted to open the suction opening upon suction through the vent and close it upon stoppage of the suction, wherein the valve body is hinged at one end so as to open and close at another end opposite diametrically of the suction opening, and the suction connecter is provided with a leg portion which presses against the valve body to thereby lock the valve body over the suction opening.

2. The valve mechanism according to claim 1, wherein the valve base has a ring member of an elastic material attached integrally to it, and the suction connector has an annular cavity formed in its portion corresponding in position to the ring member on the valve base.

3. The valve mechanism according to claim 2, wherein the valve base has ridges formed on the opposite side thereof from the suction connector and extending from a periphery of the suction opening.

4. The valve mechanism according to claim 3, wherein the suction connector further comprises load restraining means provided around its vent for restraining the load of a suction device used for discharging air from the tightly closed bag.

5. The valve mechanism according to claim 3, wherein the ring member is dimensioned to fit into an annular cavity with a portion of the bag around the periphery of an opening in one wall retained in air-tight relation.

6. The valve mechanism according to claim 2, wherein the suction connector further comprises load restraining means provided around its vent for restraining the load of a suction device used for discharging air from the tightly closed bag.

7. The valve mechanism according to claim 2, wherein the ring member is dimensioned to fit into the annular cavity with a portion of the bag around the periphery of an opening in one wall retained in air-tight relation therebetween.

8. The valve mechanism according to claim 1, wherein the valve base has ridges formed on the opposite side thereof from the suction connector and extending from a periphery of the suction opening.

9. The valve mechanism according to claim 8, wherein the suction connector further comprises load restraining means provided around its vent for restraining the load of a suction device used for discharging air from the tightly closed bag.

10. The valve mechanism according to claim 1, wherein the suction connector further comprises load restraining means provided around its vent for restraining the load of a suction device used for discharging air from the tightly closed bag.

* * * * *